US010166589B2

(12) United States Patent
Loesch

(10) Patent No.: US 10,166,589 B2
(45) Date of Patent: Jan. 1, 2019

(54) FORMING TOOL AND METHOD FOR HOT FORMING AND PARTIALLY PRESS HARDENING A WORKPIECE MADE OF SHEET STEEL

(71) Applicant: Gestamp Umformtechnik GmbH, Bielefeld (DE)

(72) Inventor: Siegfried Loesch, Berlin (DE)

(73) Assignee: Gestamp Umformtechnik GmbH, Bielefeld (DE)

( * ) Notice: Subject to any disclaimer, the term of this patent is extended or adjusted under 35 U.S.C. 154(b) by 0 days.

(21) Appl. No.: 15/601,189

(22) Filed: May 22, 2017

(65) Prior Publication Data

US 2017/0252791 A1 Sep. 7, 2017

Related U.S. Application Data

(62) Division of application No. 13/810,992, filed as application No. PCT/EP2011/061399 on Jul. 6, 2011, now Pat. No. 9,687,898.

(30) Foreign Application Priority Data

Jul. 19, 2010 (DE) ..... 10 2010 027 554

(51) Int. Cl.
*B21D 22/02* (2006.01)
*B21D 22/06* (2006.01)
(Continued)

(52) U.S. Cl.
CPC ..... *B21D 22/022* (2013.01); *B21D 22/06* (2013.01); *B21D 22/208* (2013.01); *B21D 22/22* (2013.01);
(Continued)

(58) Field of Classification Search
CPC ..... B21D 22/06; B21D 22/22; B21D 22/022; B21D 22/208; B21D 37/16; B21D 37/08;
(Continued)

(56) References Cited

U.S. PATENT DOCUMENTS 5,868,026 A 2/1999 Sarkisian et al.
6,550,302 B1 4/2003 Ghosh
(Continued)

FOREIGN PATENT DOCUMENTS

CN 1943899 A 4/2007
CN 1943906 A 4/2007
(Continued)

*Primary Examiner* — Pradeep C Battula
(74) *Attorney, Agent, or Firm* — The Webb Law Firm

(57) ABSTRACT

A forming tool for hot forming and partially press hardening a workpiece made of sheet steel including a die, a punch, and a cooling device. The die is formed of a first die part and at least one second die part which is movable relative to the first die part, while the punch is formed of a first punch part and at least one second punch part which is movable relative to the first punch part, the at least one movable second die part and the at least one movable second punch part interacting with an opening device which causes the at least one second die part and the at least one second punch part to contact the workpiece with a shorter closing time than the first die part and the first punch part.

5 Claims, 5 Drawing Sheets

(51) Int. Cl.

| | |
|---|---|
| ***B21D 22/20*** | (2006.01) |
| ***B21D 22/22*** | (2006.01) |
| ***B21D 37/08*** | (2006.01) |
| ***B21D 37/16*** | (2006.01) |
| ***C21D 1/673*** | (2006.01) |
| ***C21D 9/00*** | (2006.01) |
| *C21D 9/48* | (2006.01) |

(52) U.S. Cl.
CPC ..... *B21D 37/08* (2013.01); *B21D 37/16* (2013.01); *C21D 1/673* (2013.01); *C21D 9/0062* (2013.01); *C21D 9/48* (2013.01); *C21D 2221/00* (2013.01)

(58) Field of Classification Search
CPC .... C21D 9/48; C21D 9/0062; C21D 2221/00; C21D 1/673; B21J 13/02; B21J 13/025
See application file for complete search history.

(56) References Cited

U.S. PATENT DOCUMENTS

| | | | |
|---|---|---|---|
| 7,650,773 | B2 | 1/2010 | Shikano et al. |
| 7,895,874 | B2 | 3/2011 | Mathai et al. |
| 8,047,037 | B2 | 11/2011 | Vehof et al. |
| 8,118,954 | B2 | 2/2012 | Beenken et al. |
| 8,402,804 | B2 | 3/2013 | Nakao et al. |
| 8,511,134 | B2 | 8/2013 | Brennand et al. |
| 8,578,750 | B2 | 11/2013 | Fang |
| 8,707,751 | B2 | 4/2014 | Hielscher et al. |
| 9,394,578 | B2 | 7/2016 | Lee et al. |
| 9,427,789 | B2 | 8/2016 | Kong |
| 2002/0113041 | A1 | 8/2002 | Ozawa |
| 2010/0064759 | A1 | 3/2010 | Kondo et al. |
| 2011/0030442 | A1 | 2/2011 | Lety et al. |
| 2011/0192232 | A1 | 8/2011 | Kuwayama et al. |
| 2011/0252856 | A1 | 10/2011 | Matsuda et al. |

FOREIGN PATENT DOCUMENTS

| | | | | | |
|---|---|---|---|---|---|
| CN | 200948483 | Y | | 9/2007 | |
| CN | 101189350 | A | | 5/2008 | |
| DE | 102009018798 | A1 | | 10/2009 | |
| FR | 2927828 | A1 | | 8/2009 | |
| JP | 2006326620 | A | | 12/2006 | |
| WO | 2006038868 | A1 | | 4/2006 | |
| WO | WO 2006128821 | A1 | * | 12/2006 | ..... B21D 22/022 |
| WO | WO 2008025387 | A1 | * | 3/2008 | ..... B21D 37/16 |

* cited by examiner

FORMING TOOL AND METHOD FOR HOT FORMING AND PARTIALLY PRESS HARDENING A WORKPIECE MADE OF SHEET STEEL

CROSS-REFERENCE TO RELATED APPLICATIONS

This application is a divisional application of U.S. application Ser. No. 13/810,992 filed Apr. 3, 2013 which is the United States national phase of International Application No. PCT/EP2011/061399 filed Jul. 6, 2011, and claims priority to German Patent Application No. 10 2010 027 554.9 filed on Jul. 19, 2010, the disclosures of which are hereby incorporated by reference in their entirety.

BACKGROUND OF THE INVENTION

Field of the Invention

The invention relates to a forming tool for hot forming and partially press hardening a workpiece made of sheet steel, comprising a die, a punch which can be inserted into a cavity of the die to form the workpiece, and a cooling device. In particular, the invention relates to a method for hot forming and partially press hardening a workpiece made of sheet steel, in which the workpiece is heated prior to forming and is subsequently hot formed in a forming tool comprising a die and a punch which can be inserted into a cavity of the die, the forming tool comprising a cooling device.

Description of the Related Art

The hot forming of blanks made of higher strength and super high strength steels to produce press hardened components has become established in vehicle construction in recent years. In this context, numerous ideas for producing partially hardened components having different textures have also been developed, inter alia. An idea known from DE 10 2006 019 395 A1 is the heating of a blank consisting of suitable steel to a temperature higher than the austenitising temperature and the immediately subsequent forming in a hot forming tool which is provided in at least one region with a heating device for local setting of a weaker texture. However, this known idea has the drawback that at least one heating device must be provided, which results in considerable operating costs. In addition, the continuous exposure of the corresponding active surface of the forming tool to heat has a negative effect on the service life (lifetime) thereof.

SUMMARY OF THE INVENTION

The object of the present invention is to provide a method and forming tool for hot forming and partially press hardening sheet steel, which makes it possible, in a manner which is simple in terms of production, to produce mutually adjacent zones having different textures and thus different material properties in the metal component to be produced.

The method according to the invention, in which the workpiece is heated prior to forming and is subsequently hot formed in a forming tool, the forming tool comprising a cooling device, is essentially characterised in that, in the closed state of the forming tool, the contact between the workpiece and the contact surfaces of the die and the punch is interrupted in regions by moving apart a movable die part and a movable punch part from a closed position to an opened position.

Accordingly, the forming tool according to the invention comprises a die, a punch which can be inserted into a cavity of the die, and a cooling device. According to the invention, the die is formed of a first die part and at least one second die part which is movable relative to the first die part, while the punch is formed of a first punch part and at least one second punch part which is movable relative to the first punch part, the at least one movable second die part and the at least one movable second punch part interacting with an opening device which causes the at least one second die part and the at least one second punch part to contact the workpiece with a shorter closing time than the first die part and the first punch part.

The method according to the invention and the forming tool according to the invention thus make it possible, in a simple manner in terms of production, to produce mutually adjacent zones having different textures and accordingly different material properties such as strength and ductility at the metal component to be produced.

An advantageous embodiment of the forming tool according to the invention consists in the die parts being movably connected to a die carrier and the punch parts being movably connected to a punch carrier, the die carrier and the punch carrier each being provided with a ram, and the rams causing the at least one second die part and the at least one second punch part to move apart in the closed state of the first die part and the first punch part owing to the die carrier and punch carrier being moved closer together. This embodiment can be operated without significant additional energy consumption in comparison to conventional forming tools for hot forming and partial press hardening of steel blanks. In particular, this embodiment does not require any cost-intensive additional drive means for moving apart the tool parts which are used to produce at least one zone having a relatively weak texture in the component. Rather, the press ram which is already present and is used to close the forming tool, that is to say to move the punch, can be used for this purpose. When the rams of the die carrier and the punch carrier are moved back, the at least one second die part and the at least one second punch part close again prior to the opening of the die and punch, whereby the region of the workpiece (component) in which the contact between workpiece and tool active surface was interrupted is restruck.

Another advantageous embodiment of the forming tool according to the invention is characterised in that the first die part is rigidly connected and the at least one second die part is movably connected to a die carrier, while the first punch part is rigidly connected and the at least one second punch part is movably connected to a punch carrier, the die carrier and the punch carrier each being provided with a drive means causing a forward and a backward movement, and, in the closed state of the first die part and first punch part, the drive means causing the at least one second die part and the at least one second punch part to move apart. This variant of the forming tool according to the invention can be operated such that production can take place as desired with and without restriking of the workpiece, that is to say with and without re-closure of the die part movably connected to the die carrier and the punch part movably connected to the punch carrier. The moment at which the die part movably connected to the die carrier and the punch part movably connected to the punch carrier are moved apart can be controlled in a variable manner and according to the strain to be set in the workpiece in the contact region of these tool parts. The drive means for moving apart the at least one second die part and the at least one second punch part are preferably formed of hydraulic, pneumatic or hydropneumatic working cylinders.

Another preferred embodiment of the forming tool according to the invention provides that the at least one second die part and/or the at least one second punch part, which are moved apart in the closed state of the forming tool, comprise a controllable temperature conditioning device, preferably a heater. As a result, it can not only be ensured with a high level of reliability that one or more non-hardened regions are produced in the workpiece in a targeted manner; the embodiment also provides the option of setting in a variable manner the material properties of the workpiece, such as strength and strain, in a particular region thereof according to the requirements for the component to be produced.

The at least one second die part and/or the at least one second punch part can advantageously be made of a material which is a poor conductor of heat or have a surface coating which is a poor conductor of heat, in order to counteract in a targeted manner loss of heat in the regions of the workpiece which are not hardened. For example, ceramic material could be used as a material having low thermal conductivity.

An advantageous embodiment of the method according to the invention is characterised in that the contact between the workpiece and the contact surfaces of the die and the punch of the forming tool is interrupted in a clocked manner in regions by moving apart the movable die part and the movable punch part from the closed position to the opened position repeatedly or a number of times and subsequently moving the movable die part and the movable punch part back from the opened position to the closed position. The cooling rate of the hot formed workpiece can thus be reduced or varied as desired within a wide range. If, for example, the cooling rate of the component is 100° C./s in the case of continuous, that is to say uninterrupted, contact between cooled forming tool and workpiece or component, then the average cooling rate of the component can be reduced to approximately 20° C./s in the case of a clocked contact time of 0.2 seconds per second (that is to say, there is no contact for 0.8 seconds per second).

The clocked contact interruption is preferably set such that the sum of the contact times is less than the sum of the contact interruption times. Alternatively, however, the clocked contact interruption can also be set such that the sum of the contact times is equal to or greater than the sum of the contact interruption times.

BRIEF DESCRIPTION OF THE DRAWINGS

The invention will be described in detail below with reference to drawings showing a plurality of embodiments. In the drawings.

DETAILED DESCRIPTION OF THE INVENTION

Figure 1:
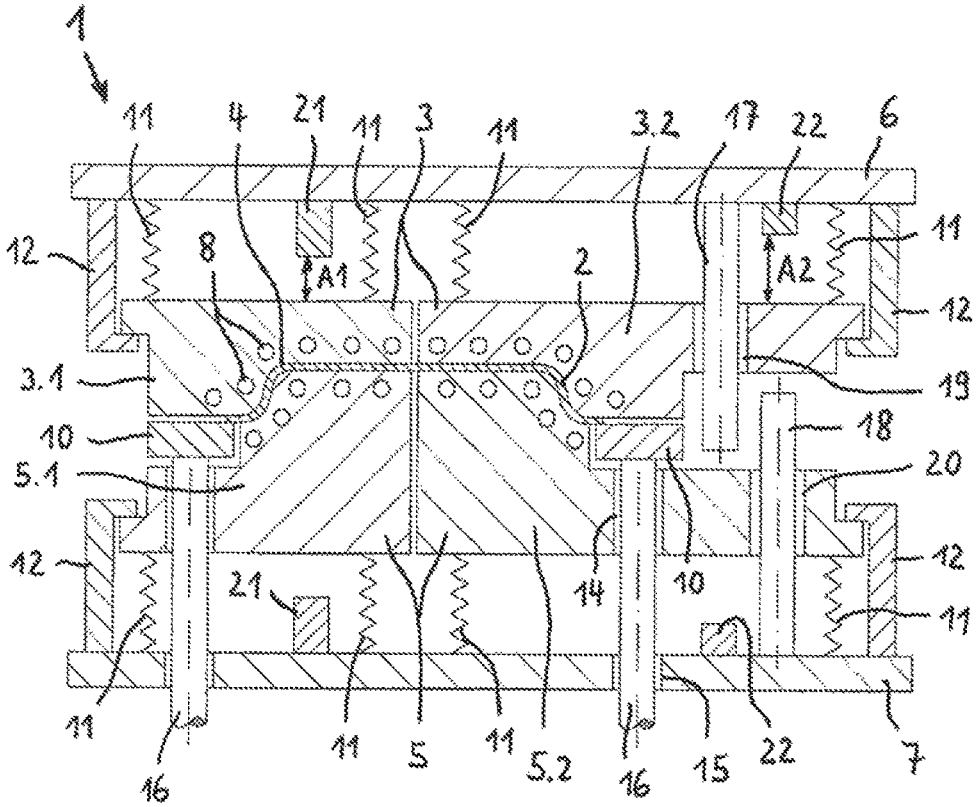
FIG. 1 is a schematic sectional view of a forming tool in the fully closed state.

The drawings show different embodiments of a forming tool 1, 1' according to the invention for hot forming and partially press hardening a blank made of higher strength or super high strength steel. The component 2 to be produced from the blank is, for example, a bumper, a B-pillar or another crash-related body component of a motor vehicle. The blank (workpiece) consists, for example, of a manganese-boron steel, in particular a manganese-boron steel of the alloy type 22 MnB5.

Regions of the component (workpiece) 2 which are to be hardened must be cooled rapidly from the austenitising temperature, while regions of the component 2 which are not to be hardened must not undergo rapid cooling.

The forming tools 1, 1' shown in the drawings provide the option of interrupting the contact between the component and the tool active surfaces in regions.

The forming tool 1, 1' is designed in the manner of a deep-drawing device and comprises a die 3. A cavity (recess) 4 is provided in the die 3 and shows the outer shape of the three-dimensionally formed component 2 to be produced.

The forming tool 1, 1' additionally comprises a punch 5 which determines the inner shape of the component 2 to be produced. The punch 5 can be moved by means of an adjustment device (press ram) (not shown) from a starting position at a distance from the die 3 to a closed position in which it is fully inserted into the cavity 4 of the die 3. The adjustment device comprises a control device which controls the speed at which the punch 5 moves into the cavity 4 of the die 3.

The die 3 is divided into at least two die parts 3.1, 3.2 which are held so as to be movable relative to one another on a stationary carrier, for example a plate 6 of a platen. The punch 5 is accordingly also divided into a corresponding number of punch parts 5.1, 5.2, each die part 3.1, 3.2 being allocated a respective punch part 5.1 or 5.2 which interacts therewith. The punch parts 5.1, 5.2 are likewise held so as to be movable relative to one another on a punch carrier 7, which for example is formed of a plate. The punch carrier or the plate 7 is mounted on the aforementioned adjustment device (not shown) by means of which the punch 5 can be moved from a starting position at a distance from the die 3 into the cavity 4 of the die 3.

In FIGS. 1 to 4, the component 2 is to be partially hardened by means of the tool parts 3.1, 5.1 shown on the left-hand side, whereas the tool parts 3.2, 5.2 shown on the right-hand side are to prevent hardening of the component 2 by interrupting the contact between the component 2 and the tool active surfaces 3.21, 5.21.

The active surface of the punch part 5.1 shown on the left-hand side and/or the active surface of the associated die part 3.1 are cooled, while the active surfaces 3.21, 5.21 of the tool parts 3.2, 5.2 shown on the right-hand side, at which a different or relatively weak texture is to be set, are cooled and/or preferably heated and/or made of a material or a surface coating which is a poor conductor of heat. For this purpose, cooling conduits 8 are made in punch part 5.1 and the die part 3.1 near the active surfaces thereof. The cooling conduits 8 are part of a cooling device (not shown in more detail). Depending on the degree of cooling required in each case, water, ice water, a deep-cooled saline solution, liquid nitrogen or another cooling medium which is suitable for rapid removal of large amounts of heat flows through the cooling conduits.

Similarly, fluid conduits 9 of a temperature conditioning device (likewise not shown in more detail) are made in the second punch part 5.2 and the die part 3.2 near the active surfaces 3.21, 5.21 thereof. A cooling medium, for example a cooling oil, is conveyed through the conduits 9 of the temperature conditioning device and causes moderate cooling of the tool parts 3.2, 5.2 in this region. Alternatively, a heating fluid, for example superheated steam, can be conveyed at least through some of the conduits 9, in particular through the conduits 9.1 arranged adjacent to the first or left-hand tool parts 3.2, 5.2. Instead of fluid conduits 9 and 9.1, heating cartridges, heating spirals or heating wires can also be integrated in the tool parts 3.2, 5.2 at which a different or relatively weak texture is to be set.

To produce the component 2, a blank made of higher strength or super high strength steel (for example of 22MnB5) is initially heated to austenitising temperature in an oven (not shown). The workpiece (blank) is then placed in the opened forming tool 1, 1' such that the edge of the workpiece is arranged on the upper side of the die 3. Blank holders 10 which hold the edge region of the workpiece down during the subsequent forming thereof are then applied. The holding force exerted by the blank holder 10 can be adjusted according to the forming speed in each case in order to allow optimised flow of the workpiece 2 into the cavity 4 of the die 3.

The punch 5 is then brought down onto the sheet steel at high speed such that the strongly cooled end face of the punch part 5.1 at which press hardening of the sheet steel 2 is to take place comes rapidly into intensive contact with the surface portion of the sheet steel 2 associated with said end face.

An opening device is allocated to the tool parts 3.2, 5.2 shown on the right-hand side in FIGS. 1 to 4 and causes the second punch part 5.2 and second die part 3.2 to contact the workpiece 2 with a shorter closing time than the first punch part 5.1 and the first die part 3.1. The portion 2.1 of the sheet steel 2 is thus quenched so rapidly that a texture or region having a hardness which is greater than the hardness of the portion 2.2, adjacent to the portion 2.1, of the sheet steel is formed there.

Figure 2:
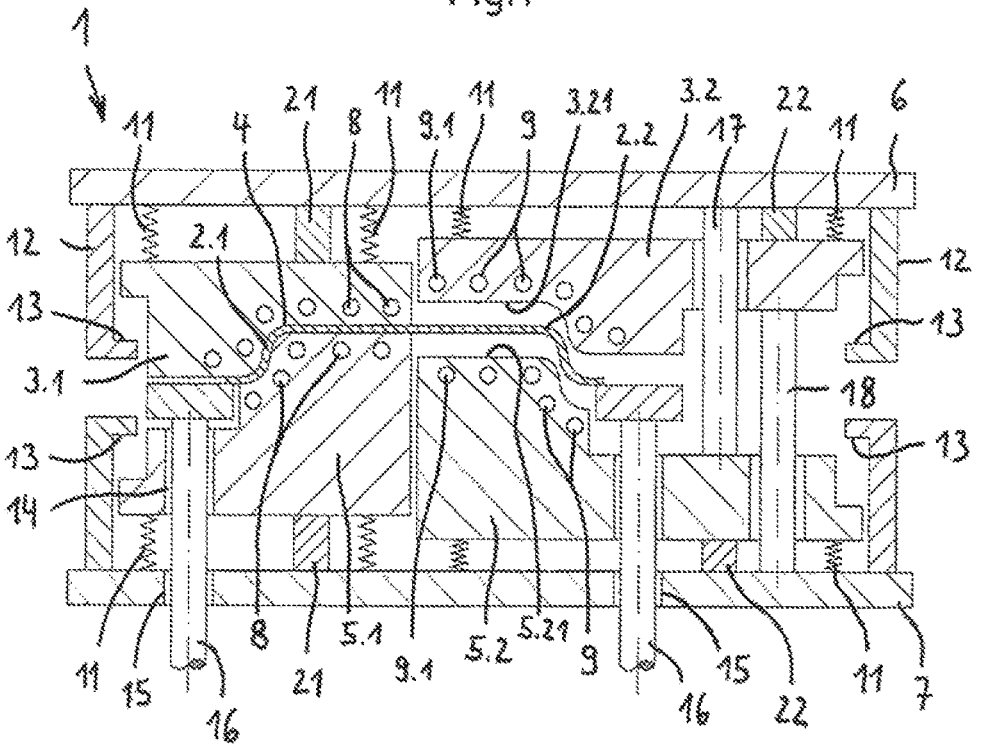
FIG. 2 is a schematic sectional view of the forming tool from FIG. 1 in a partially closed state.

In the embodiment shown in FIGS. 1 and 2, the die parts 3.1, 3.2 and the punch parts 5.1, 5.2 are resiliently supported relative to the associated plate 6 of the platen or the punch plate 7. For this purpose, spring elements 11, for example helical springs or the like, are arranged between the respective plate 6 or 7 and the die parts 3.1, 3.2 and punch parts 5.1, 5.2 respectively held thereon. In addition, the plates 6 and 7 are provided with supports 12 which form stops 13 associated with the die parts 3.1, 3.2 and punch parts 5.1, 5.2. Via the spring elements 11, the movable die parts 3.1, 3.2 and punch parts 5.1, 5.2 are tensioned against the stops 13. The punch parts 5.1, 5.2 and the plate-shaped punch carrier 7 comprise recesses (openings) 14, 15 for pressure rods 16 carrying the blank holders 10. The pressure rods 16 penetrate the recesses 14, 15 with clearance.

In addition, the resiliently supported die parts 3.1, 3.2 and punch parts 5.1, 5.2 are each provided with guides (not shown in more detail) which define the direction of movement of the die parts and punch parts 3.1, 3.2, 5.1, 5.2 during closure and opening of the forming tool 1.

In addition, the plate 6 which serves as a die carrier and the plate-shaped punch carrier 7 are provided with rams 17, 18. The respective ram 17, 18 penetrates an opening (through-hole) 19, 20 formed in the punch part 5.2 and die part 3.2 respectively. The rams 17, 18 and accordingly the openings 19, 20 are axially offset from one another.

In addition, the plate-shaped die carrier 6 and the punch carrier 7 are provided with further stops 21, 22 which face the rear sides of the linearly displaceable punch parts 5.1, 5.2 and die parts 3.1, 3.2. In the closed position of the forming tool 1 shown in FIG. 1, the end faces of the stops 21 facing the tool parts 3.1, 5.1 are at a distance A1 from the rear side of the tool parts 3.1, 5.1 which is less than the distance A2 which the end faces of the stops 22 facing the rear sides of the tool parts 3.2, 5.2 have from the tool parts 3.2, 5.2.

When the forming tool 1 is fully closed, the rams 17, 18 cause the punch part 5.2 and the die part 3.2 to move apart, that is to say a partial opening of the forming tool 1, when the die carrier 6 and the punch part 7 are moved closer together, such that the contact between component 2 and tool active surface is interrupted in regions (cf. FIGS. 1 and 2). In this case, the interruption of the contact between tool active surface 3.21, 5.21 and component 2, that is to say the partial opening of the forming tool 1, takes place before and after the press ram together with the punch 5 has reached its bottom dead centre in relation to the stationary platen 6.

The closing time of the punch part 5.2 and the die part 3.2 can be set via the ram speed, that is to say the speed at which the punch 5 is moved towards the plate 6, and the spacing of the stops 21, 22. When the ram 18 is moved back, the die part 3.2 and the punch part 5.2 close again before the opening of the die part 3.1 and the punch part 5.1, whereby the region 2.2 of the component 2 in which a relatively weak texture has been produced is again restruck.

Figure 3:
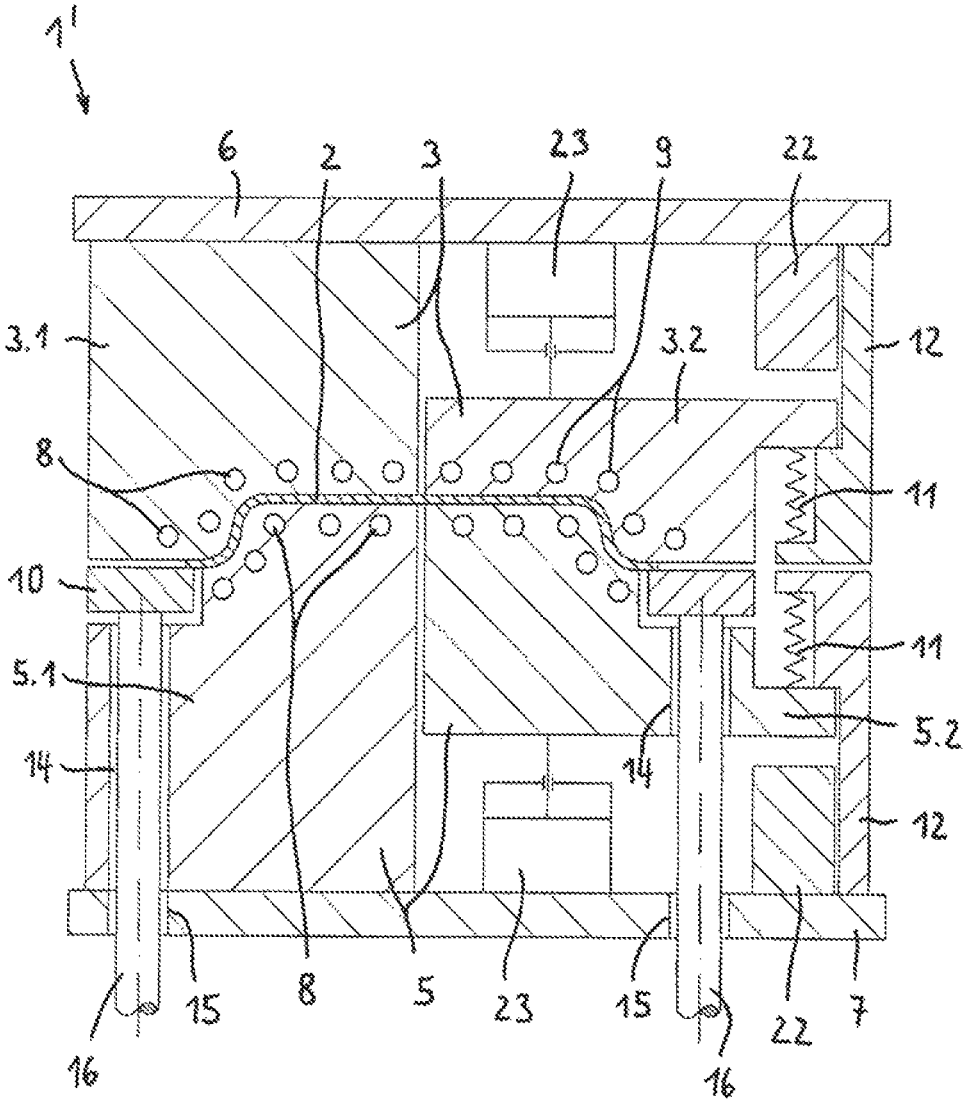
FIG. 3 is a schematic sectional view of a further forming tool in the fully closed state.
Figure 4:
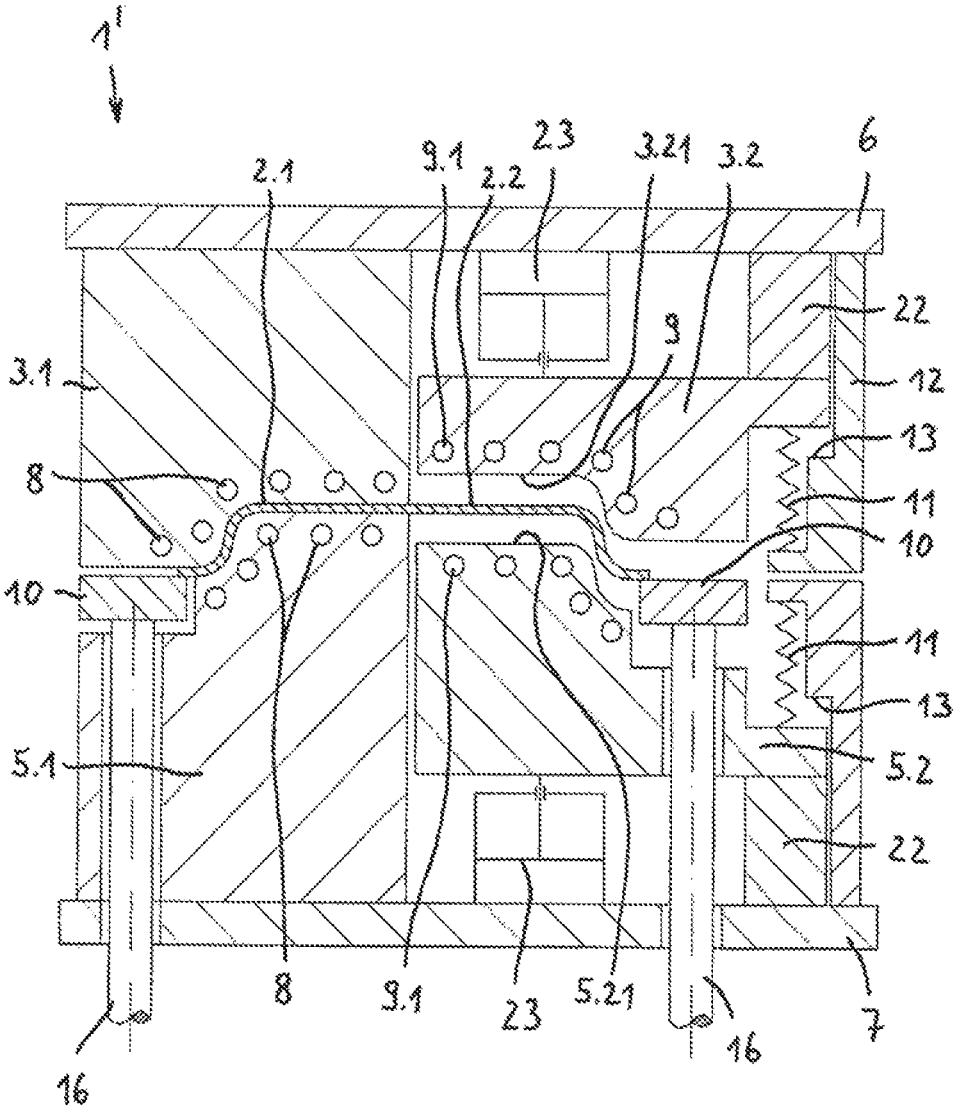
FIG. 4 is a schematic sectional view of the forming tool from FIG. 3 in a partially closed state.

In the embodiment shown in FIGS. 3 and 4 of the forming tool 1' according to the invention, the die part 3.1 and the punch part 5.1, at which the component is to be partially hardened, are rigidly connected to the die carrier (platen) 6 and punch carrier 7 respectively. The die part 3.2 and the punch part 5.2, at which a relatively weak texture is to be set in the component 2, are by contrast movably supported relative to the die carrier 6 and punch carrier 7 respectively via cylinders (working cylinders) 23.

The punch parts 5.1, 5.2 and the plate-shaped punch carrier 7 again comprise recesses (through-holes) 14, 15 which are penetrated with clearance by the pressure rods 16 carrying the blank holders 10.

The die carrier 6 and the punch carrier 7 are also provided with stops 13, 22 which limit the range of movement of the die part 3.2 and the punch part 5.2. The stops are formed on supports 12, at which the die part 3.2 and the punch part 5.2 are additionally supported via spring elements 11. The spring elements 11, which are preferably designed as helical springs, act on the side of the punch part 5.2 and the die part 3.2 respectively which is opposite the working cylinder 23.

The contact between tool active surface 3.21, 5.21 and component 2 at the bottom dead centre of the press is interrupted by means of the working cylinders 23, which can be operated pneumatically, hydraulically or hydropneumatically.

The forming tool 1' according to FIGS. 3 and 4 can be operated such that the forming and partial press hardening can take place as desired with or without restriking of the workpiece 2, that is to say with or without re-closure of the movable die part 3.2 and the movable punch part 5.2 prior to the opening of the die part 3.1 and the punch part 5.1 firmly mounted on the platen (die carrier 6) and the punch carrier 7 respectively.

Figure 5:
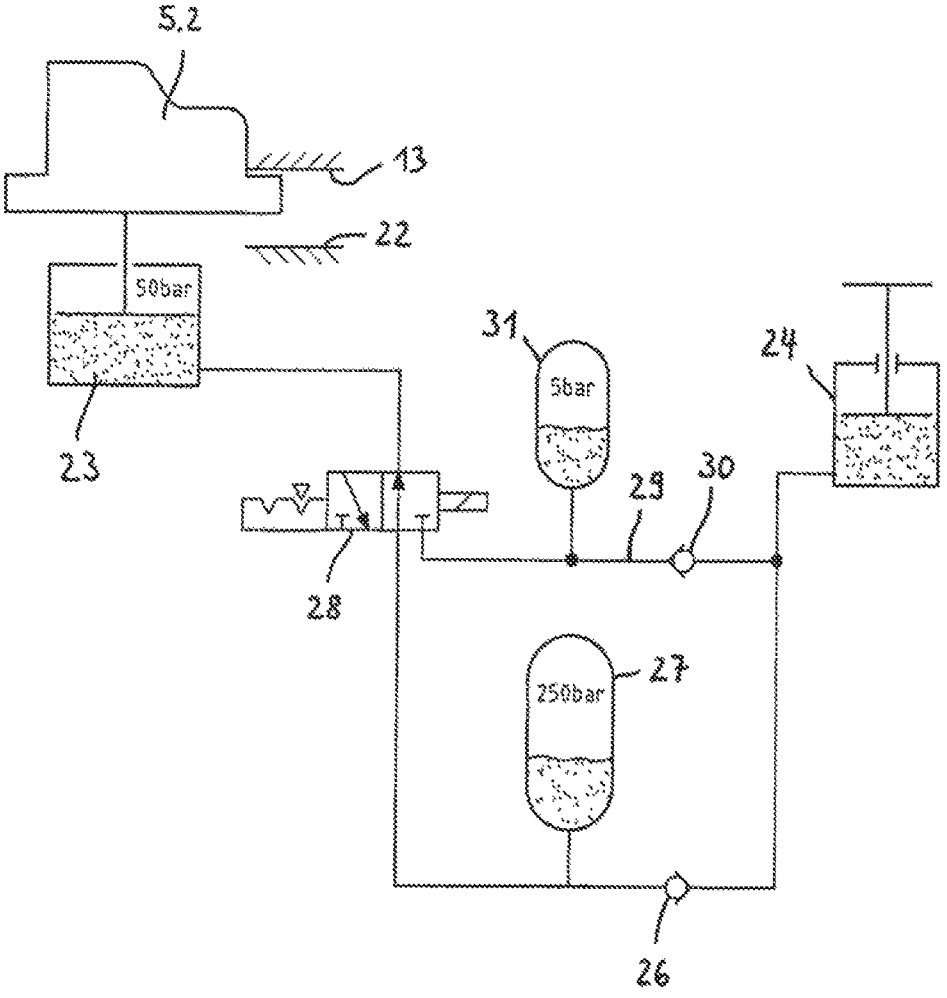
FIG. 5 shows schematically a hydropneumatic device for driving and for controlling the partial opening of the forming tool from FIGS. 3 and 4.

FIG. 5 shows a device for driving and for controlling the movable tool elements 3.2, 5.2 of the forming tool 1' shown in FIGS. 3 and 4. The device comprises a hydraulic cylinder 24 which operates in the manner of a pump and is driven by the press ram of the forming press with each press stroke. The hydraulic cylinder 24 is preferably filled with oil and connected via a hydraulic line 25 to the working cylinder 23 which is coupled to the movable punch part 5.2 and the movable die part. In this case, the respective working cylinder 23 consists of a hydropneumatic cylinder, one piston end of which is acted on by the oil flowing through the hydraulic line 25, while the other piston end is acted on by a compressed gas. The gas pressure in the cylinder 23 can for example be approximately 50 bar in the closed state of the movable punch part 5.2 and the associated movable die part 3.2. Reference numerals 13, 22 in FIG. 5 denote the stops of the movable punch part 5.2.

A valve 26, preferably a check valve, is arranged in the hydraulic line 25. In addition, a hydropneumatic pressure accumulator 27 is connected to the hydraulic line 25 between the check valve 26 and the working cylinder 23. The gas pressure in the pressure accumulator 27 is for example approximately 250 bar in the closed state of the punch part 5.2 and the die part 3.2. The hydraulic line 25 is also provided with a 3/2-way valve 28, at the third port of which a return line 29 bypassing the valve 26 is connected. Also arranged in the return line 29 is a valve 30, preferably a check valve, which acts in opposition to the valve 26. In addition, a hydropneumatic pressure accumulator 31 is again connected between the valve 30 and the 3/2-way valve 28. The gas pressure in this pressure accumulator 31 is for example approximately 5 bar in the closed state of the punch part 5.2 and the die part 3.2.

Figure 6:
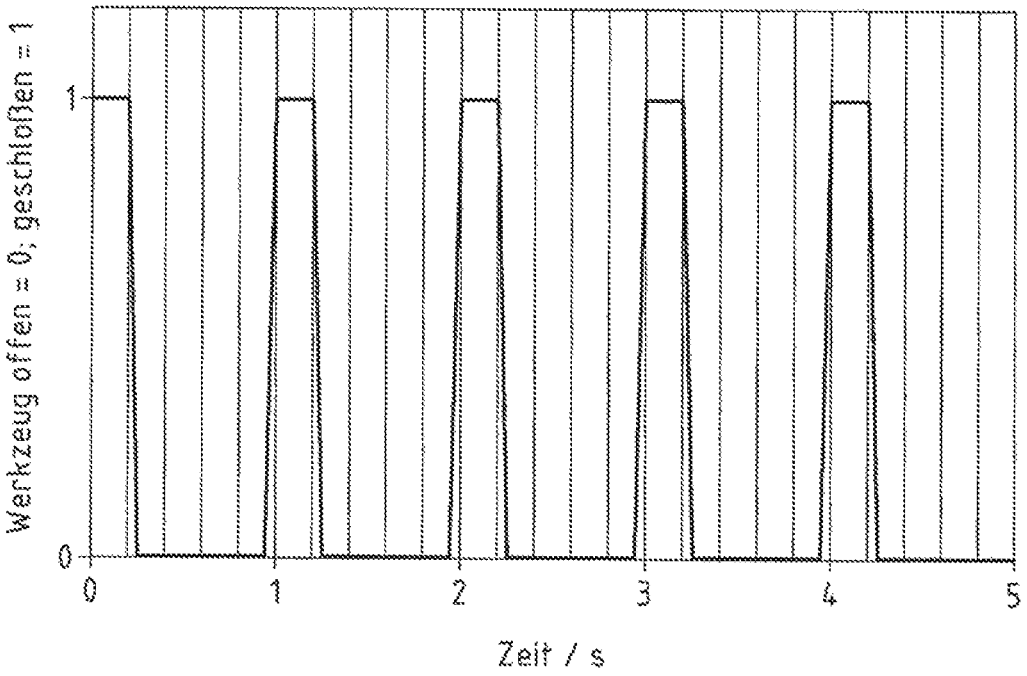
FIG. 6 is a schematic path-time diagram which illustrates a clocked interruption of the contact between forming tool and workpiece or formed component.

FIG. 6 is a path-time diagram which illustrates a mode of operation of a forming tool according to the invention or of the forming tool 1' according to FIGS. 3 and 4, in which the contact between the workpiece 2 and the contact surfaces of the die and the punch of the forming tool 1' is interrupted in a clocked manner, in that the movable die part 3.2 and the movable punch part 5.2 are moved a number of times from the closed position (FIG. 3) to the opened position (FIG. 4) and vice versa from the opened position to the closed position. In the example shown in FIG. 6 the clocked contact time is set to approximately 0.2 seconds per second. The contact between the workpiece 2 and the contact surfaces of the movable die part 3.2 and the movable punch part 5.2 is therefore interrupted for approximately 0.8 seconds per second in this case. When the cooling rate of the hot formed workpiece 2 in the region of the cooled die part 3.1 and the punch part 5.1 of the forming tool 1' is for example 100° C./s, then, in the case of clocked interruption of the contact of the workpiece 2 relative to the cooled movable die part 3.2 and the cooled movable punch part 5.2 to a contact time of approximately 0.2 seconds per second, the average cooling rate in the region of the die part 3.2 and the punch part 5.2 can be reduced to approximately 20° C./s.

The degree of the average cooling rate reduction depends mainly on the ratio of the time at which there is (partially) no contact between forming tool 1' and component 2 to the total clock time. For the aforementioned example, this means 0.8 s/1 s=0.8. The cooling rate thus decreases by approximately 80% from 100° C./s to 20° C./s. However, since, in the case of uniform contact pressure, the cooling of the component is not exactly dependent on the times at which there is partially contact and partially no contact between component and cooled forming tool, the above formula describes merely the basic trend. The times of contact and contact interruption can be varied as desired within a wide range in the clocked mode of operation according to the invention according to FIG. 6. The average cooling rate can accordingly be reduced over time by 0 to approximately 100% using the described mode of operation.

The implementation of the invention is not limited to the embodiments described above. Rather, further variants are conceivable which make use of the invention specified in the appended claims, even in the case of configuration which deviates from the embodiments shown.

The invention claimed is:

1. A forming tool for hot forming and partially press hardening a workpiece made of sheet steel, comprising:

a die, a punch which can be inserted into a cavity of the die to form the workpiece, and a cooling device, wherein the die is formed of a first die part and at least one second die part which is movable relative to the first die part, while the punch is formed of a first punch part and at least one second punch part which is movable relative to the first punch part, wherein the at least one second die part and the at least one second punch part interact with an opening device which causes the at least one second die part and the at least one second punch part to contact the workpiece for a shorter time than the first die part and the first punch part, and wherein the die parts are movably connected to a die carrier and the punch parts are movably connected to a punch carrier, the die carrier and the punch carrier each being provided with a ram, and wherein when the die carrier and the punch carrier are moved closer together, the rams cause the at least one second die part and the at least one second punch part to move apart.

2. The forming tool according to claim 1, wherein at least one of the first die part and the first punch part comprise a part of the cooling device.

3. The forming tool according to claim 1, wherein at least one of the at least one second die part and the at least one second punch part comprise a controllable temperature conditioning device.

4. The forming tool according to claim 3, wherein the temperature conditioning device is a heater.

5. The forming tool according to claim 1, wherein at least one of the at least one second die part and the at least one second punch part is made of a material which is a poor conductor of heat or has a surface coating which is a poor conductor of heat.

* * * * *